US007322905B2

(12) United States Patent
Morris

(10) Patent No.: US 7,322,905 B2
(45) Date of Patent: Jan. 29, 2008

(54) EXERCISE MACHINE WITH VARIABLE RESISTANCE UNIT AND BRAKING UNIT

(76) Inventor: Phillip E. Morris, 1301 Jane La., Greenwood, MS (US) 38930

( * ) Notice: Subject to any disclaimer, the term of this patent is extended or adjusted under 35 U.S.C. 154(b) by 1080 days.

(21) Appl. No.: 10/043,153

(22) Filed: Jan. 14, 2002

(65) Prior Publication Data

US 2002/0086780 A1 Jul. 4, 2002

Related U.S. Application Data

(63) Continuation-in-part of application No. 09/568,045, filed on May 10, 2000, now Pat. No. 6,612,971.

(51) Int. Cl.
*A63B 71/00* (2006.01)

(52) U.S. Cl. ..... 482/74; 482/118; 73/379.06

(58) Field of Classification Search ..... 482/14, 482/68, 74, 93, 136, 137, 148, 114, 115, 118; 73/379.06; 273/451; 473/441, 445
See application file for complete search history.

(56) References Cited

U.S. PATENT DOCUMENTS

| | | | | | |
|---|---|---|---|---|---|
| 3,062,548 | A | | 11/1962 | Foster et al. | 273/55 |
| 3,279,567 | A | * | 10/1966 | Kempel | 188/176 |
| 3,326,553 | A | | 6/1967 | Forrest | 273/55 |
| 3,352,426 | A | * | 11/1967 | Carlson | 211/22 |
| 3,972,238 | A | | 8/1976 | Thatcher | 73/380 |
| 4,018,440 | A | * | 4/1977 | Deutsch | 482/68 |
| 4,211,309 | A | * | 7/1980 | Ruggiero | 188/83 |
| 4,384,713 | A | * | 5/1983 | Deutsch et al. | 482/68 |
| 4,387,908 | A | | 6/1983 | Kroger et al. | 280/63 |
| 4,438,921 | A | * | 3/1984 | Szymski | 482/57 |
| 4,447,056 | A | | 5/1984 | Dalton | 273/55 |
| 4,451,037 | A | | 5/1984 | O'Hare | 273/55 |
| 4,505,473 | A | | 3/1985 | Pro | 272/73 |
| 4,838,565 | A | | 6/1989 | Douglas et al. | 280/1.5 |
| 4,844,459 | A | | 7/1989 | Francis et al. | 273/55 |
| 4,867,439 | A | * | 9/1989 | Salyer | 482/68 |
| 5,070,816 | A | | 12/1991 | Wehrell | 119/29 |
| 5,108,091 | A | * | 4/1992 | Chang | 482/64 |
| 5,197,931 | A | | 3/1993 | Wroclawsky | 482/74 |
| 5,284,462 | A | * | 2/1994 | Olschansky et al. | 482/62 |
| 5,375,861 | A | | 12/1994 | Gifford | 280/47.38 |
| 5,529,554 | A | * | 6/1996 | Eschenbach | 482/57 |
| 5,743,821 | A | | 4/1998 | Wirachowski | 473/441 |
| 6,299,195 | B1 | * | 10/2001 | Chan | 280/651 |
| 6,338,355 | B1 | * | 1/2002 | Cheng | 135/67 |
| 6,488,130 | B1 | * | 12/2002 | Bermel | 188/19 |
| 6,612,971 | B1 | * | 9/2003 | Morris | 482/74 |

* cited by examiner

*Primary Examiner*—Jerome Donnelly
*Assistant Examiner*—Tam Nguyen
(74) *Attorney, Agent, or Firm*—Kenyon & Kenyon LLP

(57) ABSTRACT

An exercise machine is disclosed. Exemplary embodiments include an exercise machine with a safety brake mechanism to provide a braking force to the exercise machine to stop the exercise machine, an exercise machine with a variable resistance mechanism to variably adjust and provide resistance to the exercise machine, and an exercise machine with both mechanisms.

31 Claims, 15 Drawing Sheets

EXERCISE MACHINE WITH VARIABLE RESISTANCE UNIT AND BRAKING UNIT

CROSS REFERENCE TO RELATED APPLICATIONS

The present application is a continuation-in-part of application Ser. No. 09/568,045, filed May 10, 2000 now U.S. Pat. No. 6,612,971.

BACKGROUND OF THE INVENTION

1. Field of the Invention

The present invention relates generally to an exercise machine. More specifically, the invention provides an exercise machine that includes a mechanism for variably adjusting the resistance provided by the exercise machine and a mechanism for safely braking the exercise machine.

2. Description of the Related Art

Many known exercise machines have some portion of the equipment designed to be pulled or pushed by an athlete or other user in a manner that typically enhances the strength of a particular muscle group. These machines generally provide a controlled resistance in some fashion against the effort required by the user to move the equipment. An example of a such known exercise machine is a blocking sled that is pushed by a football player primarily through the power provided by the player's legs to move the sled over a field.

It is also generally known that exercise machines as described above provide variable resistance to the user, which, however, generally utilize relatively complex, heavy, and unreliable apparatuses that on occasion cannot properly be controlled. Therefore, it is desirable to overcome these and other problems with a machine having a variably adjusting resistance which is more consistent and reliable than the previous art.

For example, some of these exercise machines may continue to move as a result of momentum when the user ceases pulling or pushing the equipment. Such continued motion may cause the machine to roll into the user's feet and ankles or jerk the user forward, possibly causing injury. Such a machine should include an improved mechanism for safely braking the exercise machine when the user stops the exercise.

BRIEF DESCRIPTION OF THE DRAWINGS

The various features of the invention will best be appreciated by simultaneous reference to the description which follows and the accompanying drawings, in which.

DETAILED DESCRIPTION

Figure 1:
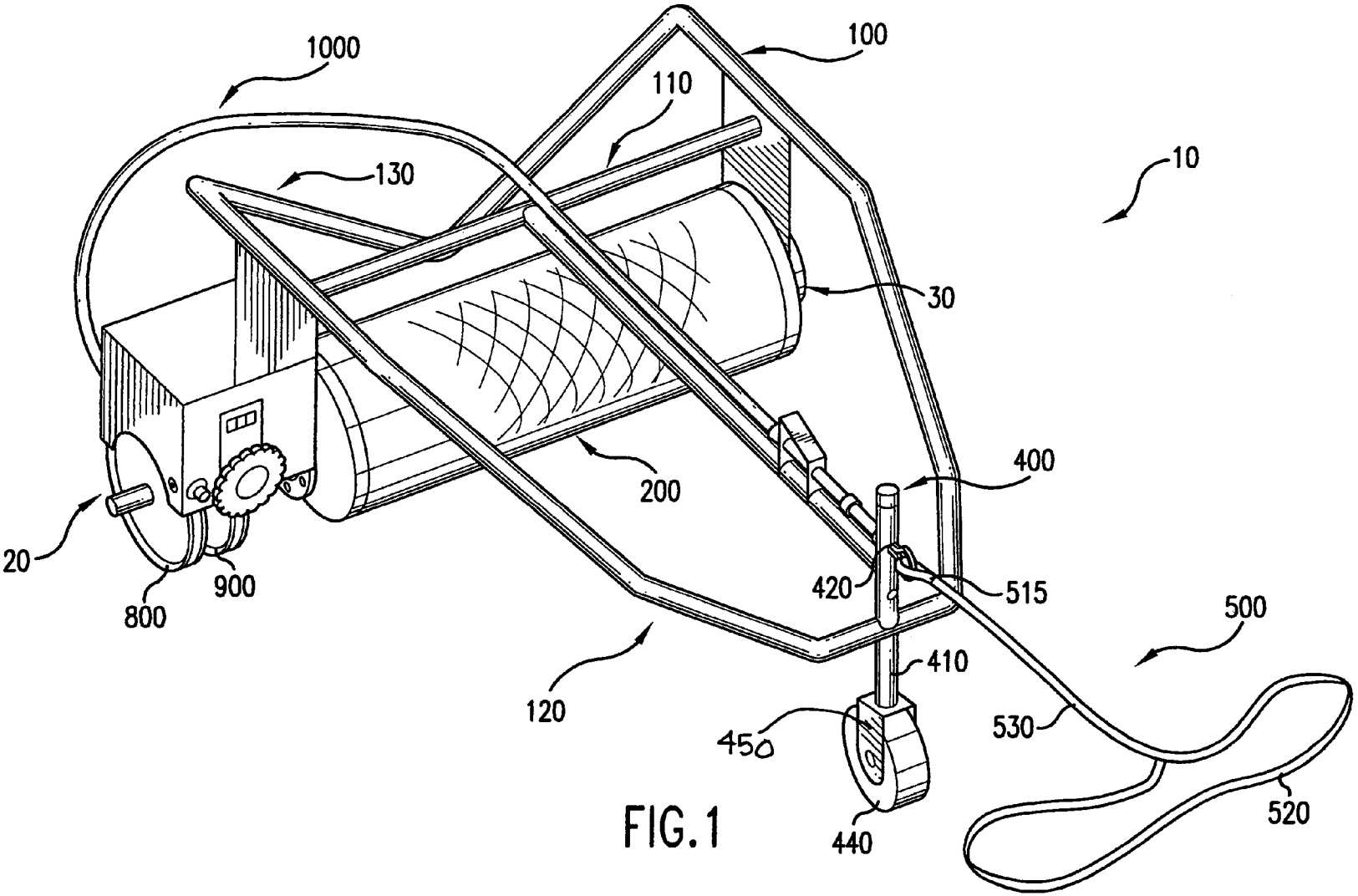
FIG. 1 is a perspective view of an embodiment of an exercise machine, with a harness attachment, in accordance with the principles of the present invention.

FIG. 1 illustrates a first embodiment of an exercise machine 10 in accordance with the principles of the present invention. As can be seen, and as will be described further later in this specification, exercise machine 10 is comprised of a frame 100, a roller 200, a support member 400, a harness assembly 500, a safety brake mechanism 800, and a variable resistance mechanism 900. As will also be further described later in this specification, in order to utilize exercise machine 10, a user straps the harness assembly 500 around his/her shoulders and then pulls exercise machine 10 along the ground behind the user. Resistance against the pulling force applied by the user is provided by exercise machine 10, and more particularly, by roller 200 and variable resistance mechanism 900. Variable resistance mechanism 900 provides for adjusting the resistance supplied by exercise machine 10, and hence roller 200. Thus, as can be understood, pulling of exercise machine 10 allows the user to develop the strength in the user's body, particularly the user's legs. As will also be further described later in this specification, in order to safely stop exercise machine 10, the user stops pulling exercise machine 10 and, hence, safety brake mechanism 800 stops the rotation of roller 200. Thus, as can be understood, when the user stops pulling exercise machine 10, roller 200 stops rotating so that roller 200 does not roll into the user causing injury.

Figure 2:
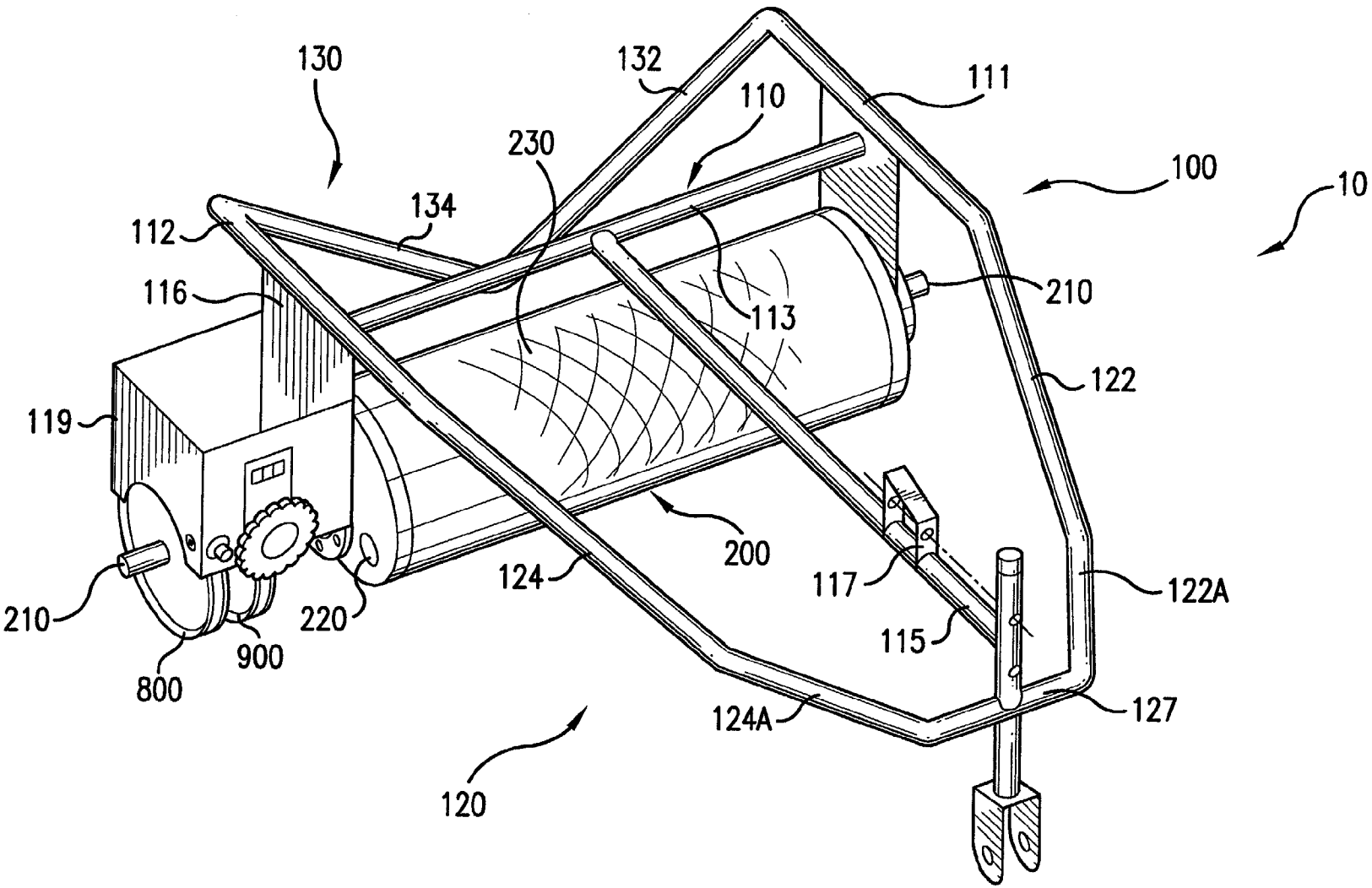
FIG. 2 is another perspective view of the exercise machine of FIG. 1 without the harness attachment.

As can be seen in FIG. 1, and as further seen in FIG. 2, frame 100 includes an overhead frame 110, a front frame 120, and a rear frame 130. Frame 100 is formed generally in an inverted u-shape and defines an internal area defined by overhead frame 110, front frame 120, and rear frame 130.

Overhead frame 10 is comprised of a first arm 111, a second arm 112, a third arm 113, and a fourth arm 115. One end of fourth arm 115 connects perpendicularly to a mid-portion of third arm 113 and extends generally upwardly and forwardly from third arm 113 to generally form a T-shaped structure. The other end of fourth arm 115 connects to an upper portion of a support member 400. Thus, fourth arm 115 provides for a first interconnection between overhead frame 110 and support member 400. In further describing overhead frame 110, a first axle support 114 extends from first arm 111 and a second axle support 116 extends from second arm 112. First and second axle supports 114, 116, respectively, extend downwardly perpendicular from first arm 111 and second arm 112, respectively. The ends of third arm 113 connect to first and second axle supports 114, 116, respectively, below first and second arms 111, 112. As such, third arm 113 extends horizontally perpendicular to first and second arms 111, 112 and fourth arm 115 extends forwardly. As can be seen, overhead frame 110 is oriented generally above roller 200. As will be described further later in this specification, first axle support 114 and second axle support 116 receive within them axle 210 of roller 200.

Front frame 120 of frame 100 includes a first arm 122, a second arm 124, and a cross member 127. First arm 122 and second arm 124 extend from an end of overhead frame 110 and extend downwardly and forwardly from overhead frame 110. A first arm extension 122A extends from a second end of first arm 122 and a second arm extension 124A extends from a second end of second arm 124. First and second arm extensions 122A, 124A, respectively, extend generally parallel to the surface upon which roller 200 rests. Cross member 127 attaches to support member 400 below fourth arm 115 at an upper mid-portion of the cross member. Thus, front frame 120 provides for a second interconnection between overhead frame 110 and support member 400. First and second arm extensions 122A, 124A are designed to keep frame 100 parallel to the surface on which exercise machine 10 rests for advantageous stable, forward movement of exercise machine 10.

Frame 100 also includes, as discussed previously, rear frame 130. Rear frame 130 includes a first arm 132 and a second arm 134. First arm 132 is attached at a first end to the second end of first arm 111 of overhead frame 110, which is the opposite end of first arm 111 from which extends first arm 122 of front frame 120. Second arm 134 is similarly attached to the second end of second arm 112 of overhead frame 110. First arm 132 and second arm 134 extend downwardly and rearwardly from overhead frame 110 and first arm 132 is interconnected with second arm 134 at the respective second ends of each arm, i.e., at ends opposite the ends from which the arms attach to the overhead frame's arms 111, 112. Thus, first arm 132 and second arm 134 of rear frame 130 generally form a v-shaped structure. The point of connection between arm 132 and arm 134 is located at a position above the surface upon which roller 200 rests. Whereas the distance that the interconnection point between first arm 132 and second arm 134 is positioned above the ground surface is not rigidly defined, it is of a sufficient distance such that, if frame 100 was rotated backward around roller 200 and thus support member 400 was raised from the ground, the connection point between first arm 132 and second arm 134 would engage the ground surface before frame 100 could be fully rotated into a near-perpendicular orientation with respect to the ground surface. Thus, as can be understood, rear frame 130 provides a safety mechanism to prevent frame 100 from being tipped over backwards should the user inadvertently raise support member 400 to a height too high off of the ground surface.

A safety brake cable support 117 is attached to the top of fourth arm 115 4near the overhead frame's fourth arm connection with support member 400. A frame extension housing 119 is attached to and extends from an external side of second axle support 116 and is thus disposed external to the internal area defined by overhead frame 110, front frame 120, and rear frame 130. Frame extension housing 119 is generally formed in a three-sided structure with an arc portion above safety brake mechanism 800. Frame extension housing 119 is attached at its ends to second axle support 116 to surround safety brake mechanism 800 and variable resistance mechanism 900. Frame extension housing 119 may be used to protect the components of mechanisms 800, 900 during use. Frame extension housing 119 will be described further later in reference to FIG. 11. As will be described later, safety brake cable support 117 and frame extension housing 119 receive within them a safety cable assembly 1000 of safety brake mechanism 800.

In continuing further with the description of exercise machine 10, as can be seen in FIGS. 1 and 2, and as will be described further later in this specification in connection with FIG. 14, roller 200 is an elongated cylindrical member that is disposed for rotation within the internal area defined by frame 100. An axle 210 extends through roller 200. As will be described further, axle 210 has a round cross-section at least along its length that extends within roller 200. Axle 210 is positioned within a complementary-shaped bore extending through roller 200 such that, as roller 200 is rotated, axle 210 rotates along with roller 200. As will also be further described later in this specification, axle 210, at its right end, which is defined as that end which includes safety brake mechanism 800 and variable resistance mechanism 900, includes a grooved portion at its distal-most end, the grooved portion having a groove along its length for insertion of a locking key.

It is desirable that roller 200 be a relatively elongated member with a length, in an embodiment, of approximately 24 inches from end to end. Longer lengths are contemplated. For example, a roller of at least 36 inches or longer can be utilized with the present invention. It is desirable that roller 200 be of a relatively long length so that sufficient resistance can be provided to the user. As can be understood, the longer and heavier that roller 200 is, the greater the possible resistance is that can be provided against the user's pulling force.

Roller 200, in an embodiment, has a diameter of approximately 12 inches and is comprised of steel. Roller 200 may be hollow and thus, may include an aperture 220 in its outer structure such that, if it is desired to add weight to the roller to provide additional resistance to the user, weight may be added to the roller by inserting the weight through aperture 220. The present invention is not limited to any particular physical embodiment for the weight that may be added and thus, weight in the form of, for example, sand, water, lead, or steel may be added within roller 200.

Because exercise machine 10 may be utilized on any of a variety of ground surfaces, including an outdoor ground surface or an indoor floor surface, an appropriate material may be included on the exterior surface of roller 200. For example, if exercise machine 10 is utilized on an indoor floor surface, it may be desirable to include a material on the exterior surface of the roller, such as rubber, that would reduce the potential of damaging the floor's surface. If the exercise machine is used outdoors, it may be desirable to include a material on the exterior surface of the roller that would increase the resistance provided by the machine such as, for example, expanded metal. As such, FIGS. 1 and 2 illustrate roller 200 with a mesh 230 around its exterior. As discussed above, mesh 230 may be comprised of any of a variety of materials. Additionally, any material that may be applied to the exterior of the roller does not have to be comprised of a mesh, but rather, can be formed in any of a variety of structures, including a solid, or contiguous, structure or a non-contiguous structure.

As was also described previously, exercise machine 10 includes safety brake mechanism 800. As can be seen, safety brake mechanism 800 is disposed external to the internal area defined by frame 100 and externally adjacent to variable resistance mechanism 900. Thus, safety brake mechanism 800 is disposed external to overhead frame 110 and roller 200. Safety brake mechanism 800 is connected to frame extension housing 119 via safety cable assembly 1000. As will be further described later in this specification, safety brake mechanism 800 applies a braking force to axle 210 which stops axle 210, and thus roller 200, preventing roller 200 from rolling when the user stops pulling exercise machine 10, i.e. when the user no longer applies a pulling force to harness assembly 500. As such, exercise machine 10 quickly stops when the user stops, thereby preventing injury to the user. Safety brake mechanism 800 will be described further later in connection to FIGS. 4-10.

As was also described previously, exercise machine 10 includes variable resistance mechanism 900. As can be seen, variable resistance mechanism 900 is disposed external to the internal area defined by frame 100 and internally adjacent to safety brake mechanism 800. Thus, variable resistance mechanism 900 is disposed external to overhead frame 110 and roller 200 between overhead frame 110 and safety brake mechanism 800. As will be further described later in this specification, variable resistance mechanism 900 applies a force to axle 210 which restrains axle 210, and thus roller 200, against rotation which in-turn provides resistance against the user's pulling force. As will also be further described later in this specification, the resistance that is applied by variable resistance mechanism 900 is variably adjustable. Thus, exercise machine 10 can be utilized for a variety of purposes. For example, a single user can adjust the resistance so that the resistance provided is appropriate for the workout that the user is trying to achieve or the resistance can be adjusted such that the resistance is appropriate for each of a plurality of different users. Variable resistance mechanism 900 will be described further later in connection with FIGS. 4-9.

Also shown in FIGS. 1 and 2 is an embodiment for support member 400. Support member 400 includes an attachment member 410 and a wheel 440. Attachment member 410 extends generally perpendicular to the ground surface upon which roller 200 rests and is attached to front frame 120 of frame 100. Wheel 440 supports exercise machine 10 at its forward end and may be rolled across a surface by the user when the user pulls exercise machine 10 behind him/her. Wheel 440 is secured to attachment member 410 with a wheel support 450. Wheel support 450 may be any appropriate securing device, including a bracket and wheel axle, capable of securing wheel 440 to attachment member 410. Wheel 440 allows the user to roll exercise machine 10 on an indoor surface, thus preventing potential damage to the indoor surface by exercise machine 10. Alternatively, wheel 440 may be used on an outdoor surface. Attachment member 410 includes at least one aperture 420 along its length to provide for attachment of harness assembly 500 to safety brake cable assembly 1000 through support member 400.

Harness assembly 500 includes a connector 515, a harness 520, and a tether 530 that interconnects connector 515 with harness 520. Connector 515 may be any of a variety of structures, including a hooked pin or a closed loop, and is utilized to connect harness assembly 500 to safety brake cable assembly 1000. As discussed previously, the user attaches harness 520 to his/her body such that the user is able to pull exercise machine 10 behind him/her during the course of exercising with exercise machine 10. And when the user stops pulling, safety brake mechanism 800 engages and stops exercise machine 10. FIG. 1 illustrates an embodiment of a flexible harness assembly. However, the present invention is not limited to any particular embodiment for a harness assembly. All that is required is that the user be able to engage with exercise machine 10 such that the user is able to pull behind him/her and safely stop exercise machine 10.

Figure 3:
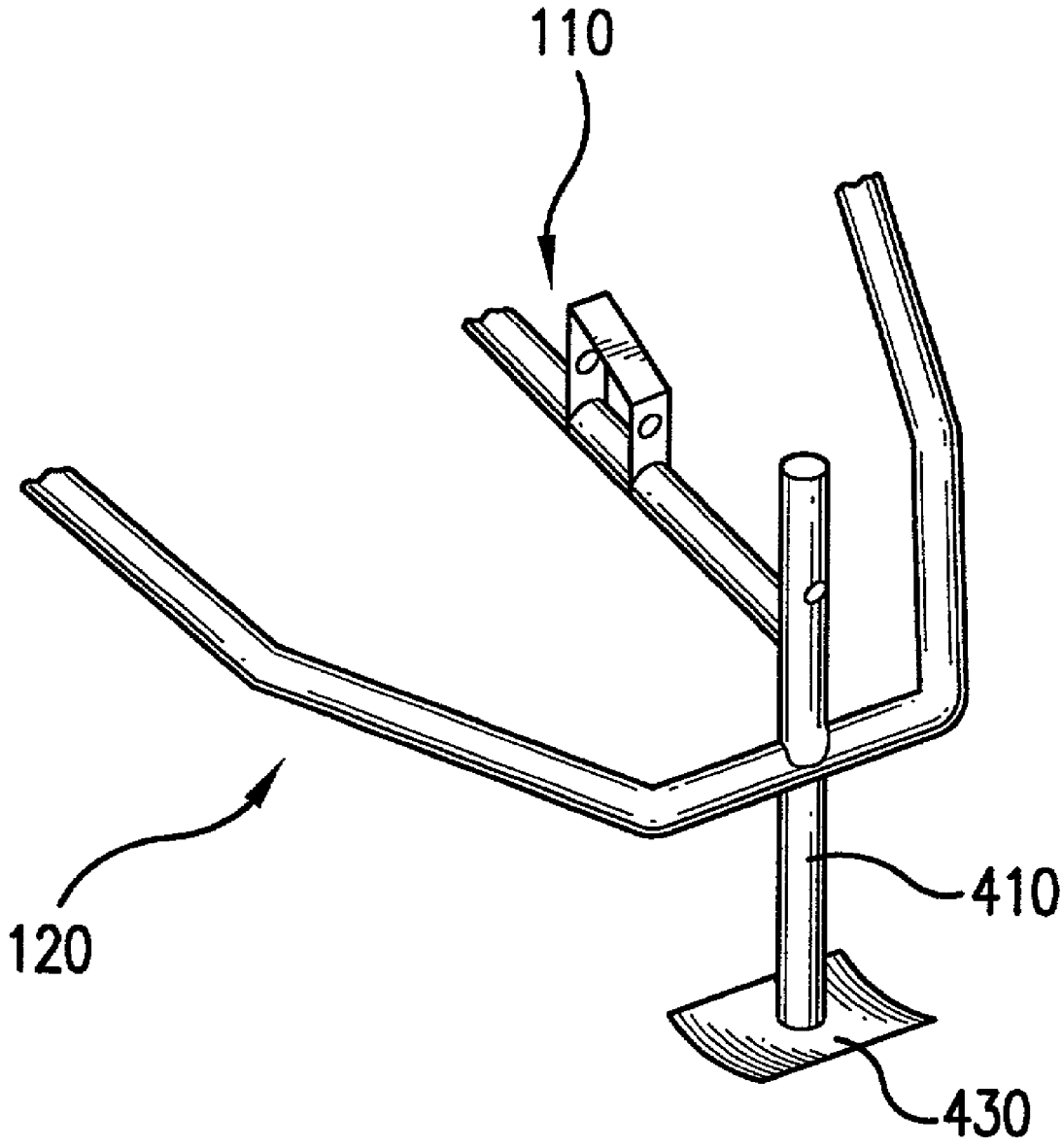
FIG. 3 is a perspective view of an alternative embodiment of a support member in accordance with the principles of the present invention.

FIG. 3 illustrates an alternative embodiment for support member 400. Support member 400 includes attachment member 410 and a skid 430. In an embodiment where exercise machine 10 is used outdoors, skid 430 may replace wheel 440 and wheel support 450 for smooth gliding across rough, uneven surfaces. Skid 430 includes a 4-inch skid plate that supports exercise machine 10 at its forward end and may be dragged across the ground by the user when the user is pulling exercise machine 10 behind him/her.

Figure 4:
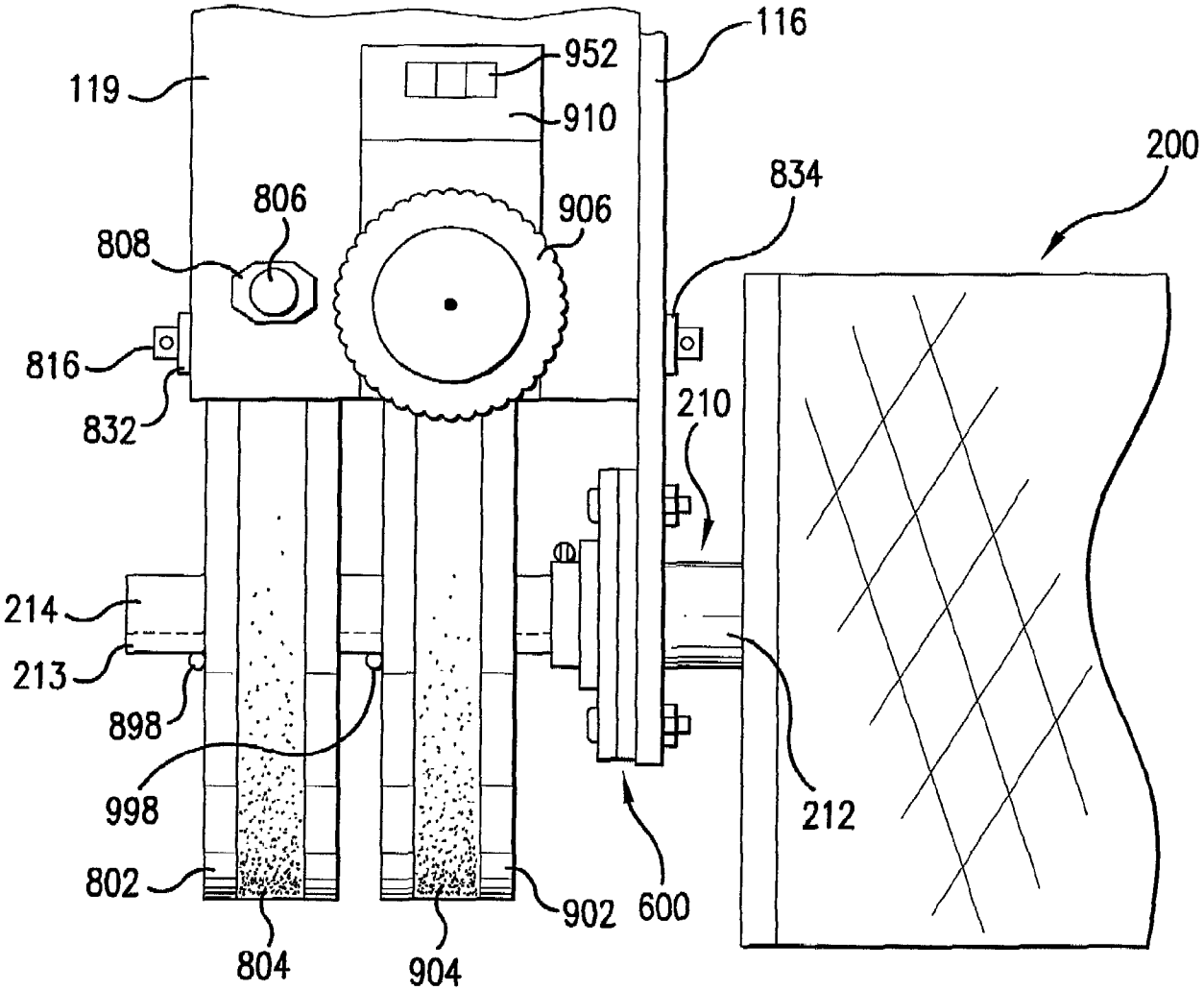
FIG. 4 is a front view of the right side of the exercise machine.

FIG. 4 illustrates a front view of the right side 20 of exercise machine 10. The right side 20 includes safety brake mechanism 800, variable resistance mechanism 900, a right roller retention assembly 600 that is utilized to support axle 210, and thus roller 200, on the right side of frame 100, and various attachment devices.

First, a description is provided of how roller 200 is supported on frame 100. As can be seen, right roller retention bearing assembly 600 is utilized to support roller 200 on second axle support 116 of frame 100. Right roller retention assembly 600 is associated with the round cross-section portion 212 of axle 210 and with the lower end of second axle support 116. Right roller retention bearing assembly 600 will be discussed later in this specification with reference to FIG. 12.

Variable resistance mechanism 900 is positioned externally adjacent to right roller retention bearing assembly 600. As can be seen in FIG. 4, and as will be described further later in this specification, variable resistance mechanism 900 is positioned on grooved portion 214 of axle 210. A variably adjustable resistance force can be applied to variable resistance hub 902 by turning a knob 906 which applies a force to a variable resistance band brake 904 which in-turn tightens around variable resistance hub 902. The tightening of band brake 904 causes hub 902 to resist rotating, which in-turn causes roller 200 to resist rotating. A resistance counter 910 measures the amount knob 906 is turned and, hence, the amount of resistance applied to resistance hub 902 and roller 200. The amount of resistance is displayed on a display 952 in tenths of knob turns. An exemplary resistance range is 0 to 10 knob turns, where a setting of 0 indicates minimum resistance and a setting of 10 indicates maximum resistance. Each increment of one represents one knob turn. As can be understood, the resistance range may be changed for a specific application. FIG. 4 illustrates a knob as the device for variably adjusting resistance. However, the present invention is not limited to any particular adjustment device. Any device that the user is able to engage in order to variably adjust the resistance to exercise machine 10 may be used, e.g. a screwdriver, wrench, or wheel.

A description will now be provided for the apparatus for mounting variable resistance hub 902 on grooved portion 214 of axle 210. Variable resistance hub 902 has a groove through a lip around the center opening, the groove having a depth approximately one-half the height of a locking key 213. Grooved portion 214 has a groove of similar depth along its length. Key 213 is slid into the groove along the length of grooved portion 214, half of key 213 being disposed above the groove and portion 214. Variable resistance hub 902 is slid onto grooved portion 214 with the groove in hub 902 contacting the half of key 213 disposed above grooved portion 214. Variable resistance hub 902 is slid to a desired position on axle 210. A set screw 998 is then threaded into the lip of the center opening of hub 902 above the groove to hold variable resistance hub 902 in place. Thus, as can be understood, variable resistance hub 902 is locked in position on grooved portion 214 of axle 210 by key 213 and set screw 998. As such, variable resistance hub 902 rotates along with roller 200.

Safety brake mechanism 800 is positioned externally adjacent to variable resistance mechanism 900. As can be seen in FIG. 4, and as will be described further later in this specification, safety brake mechanism 800 is positioned on grooved portion 214 of axle 210. A braking force is applied to safety brake hub 802 by the user stopping pulling harness assembly 500, causing a safety band brake 804 to tightens around safety brake hub 802. The tightening of band brake 804 causes hub 802 to stop rotating, which in-turn causes roller 200 to stop rotating.

As described regarding mounting variable resistance hub 902, the apparatus for mounting safety brake hub 802 on grooved portion 214 of axle 210 is essentially the same. Safety brake hub 802 has a groove in a lip around its center opening, the groove contacting the half of key 213 disposed above grooved portion 214 as safety brake hub 802 is slid onto axle 210 into a desired position. A set screw 898 is then threaded into the lip of the center opening of hub 802 above the groove to hold safety brake hub 802 in place. Thus, as can be understood, safety brake hub 802 is locked in position on grooved portion 214 of axle 210 by key 213 and set screw 898. As such, safety brake hub 802 rotates along with roller 200.

It is to be understood that the positioning order of safety brake and variable resistance mechanisms 800, 900 may be switched in the present invention.

Figure 5:
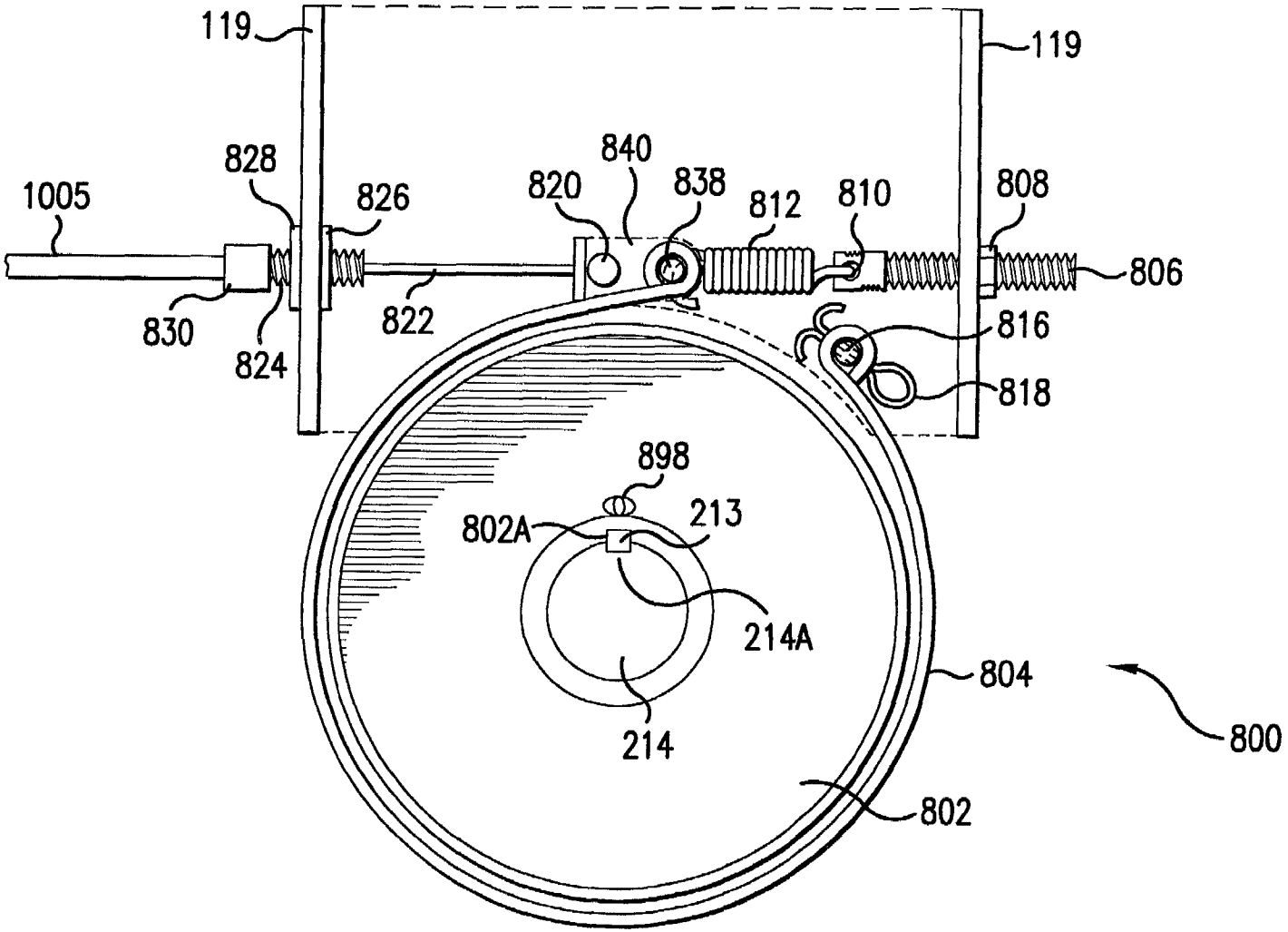
FIG. 5 is a side view of a safety brake mechanism of the exercise machine.
Figure 6:
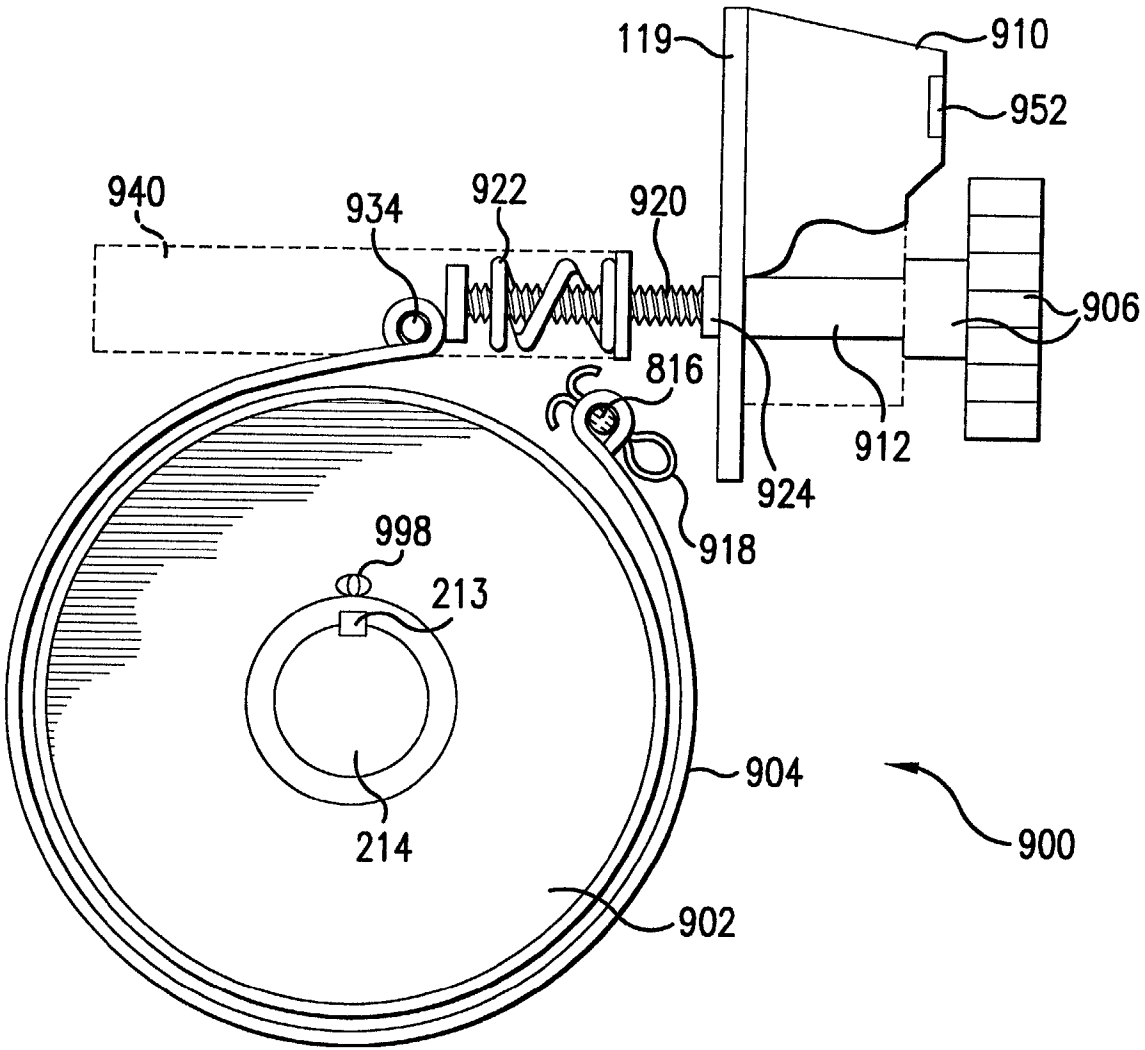
FIG. 6 is a side view of a variable resistance mechanism of the exercise machine.
Figure 7:
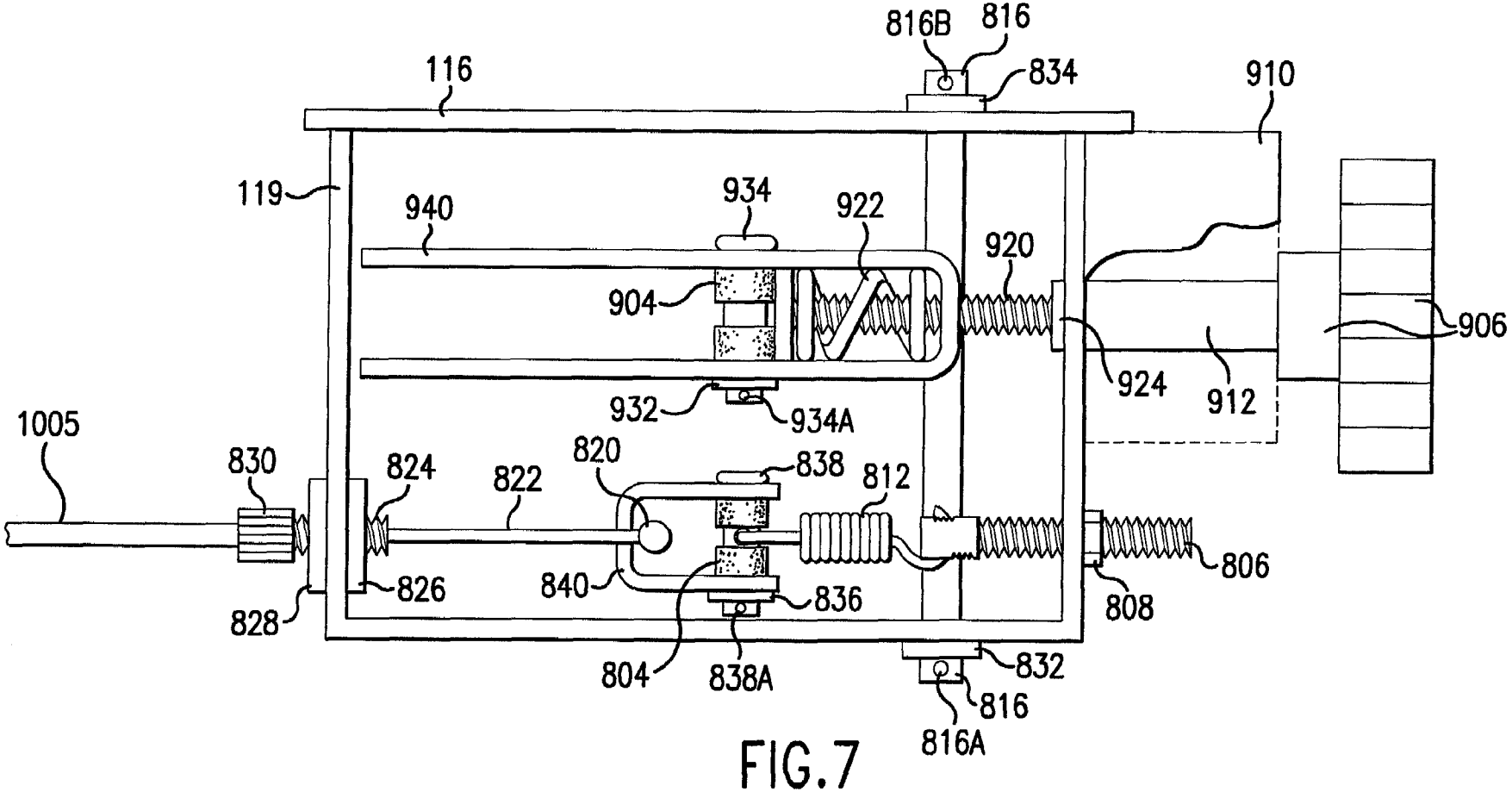
FIG. 7 is a top view of the right side of the exercise machine.
Figure 8A:
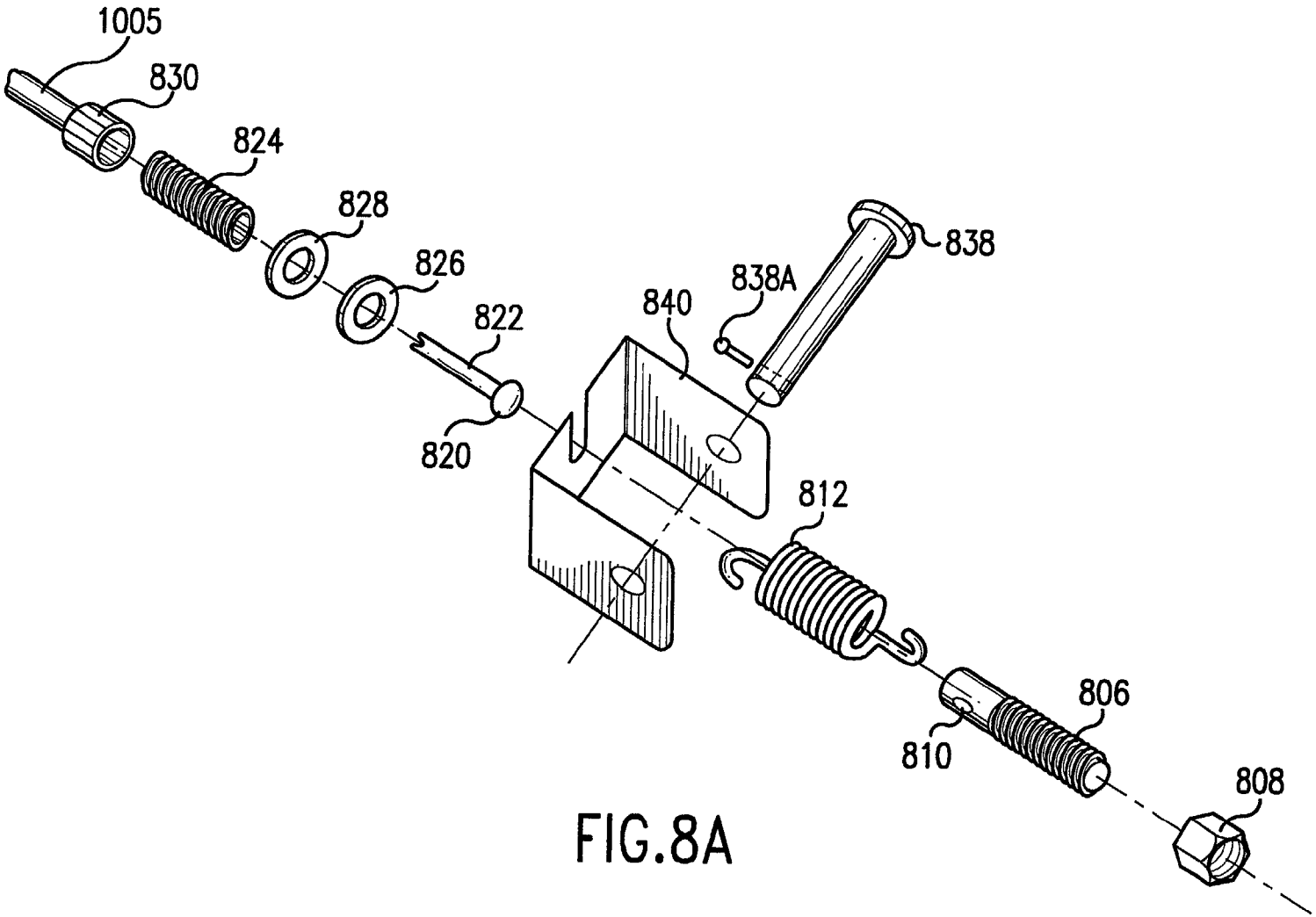
FIG. 8A is an exploded perspective view of an embodiment of a portion of the safety brake mechanism in accordance with the principles of the present invention.
Figure 8B:
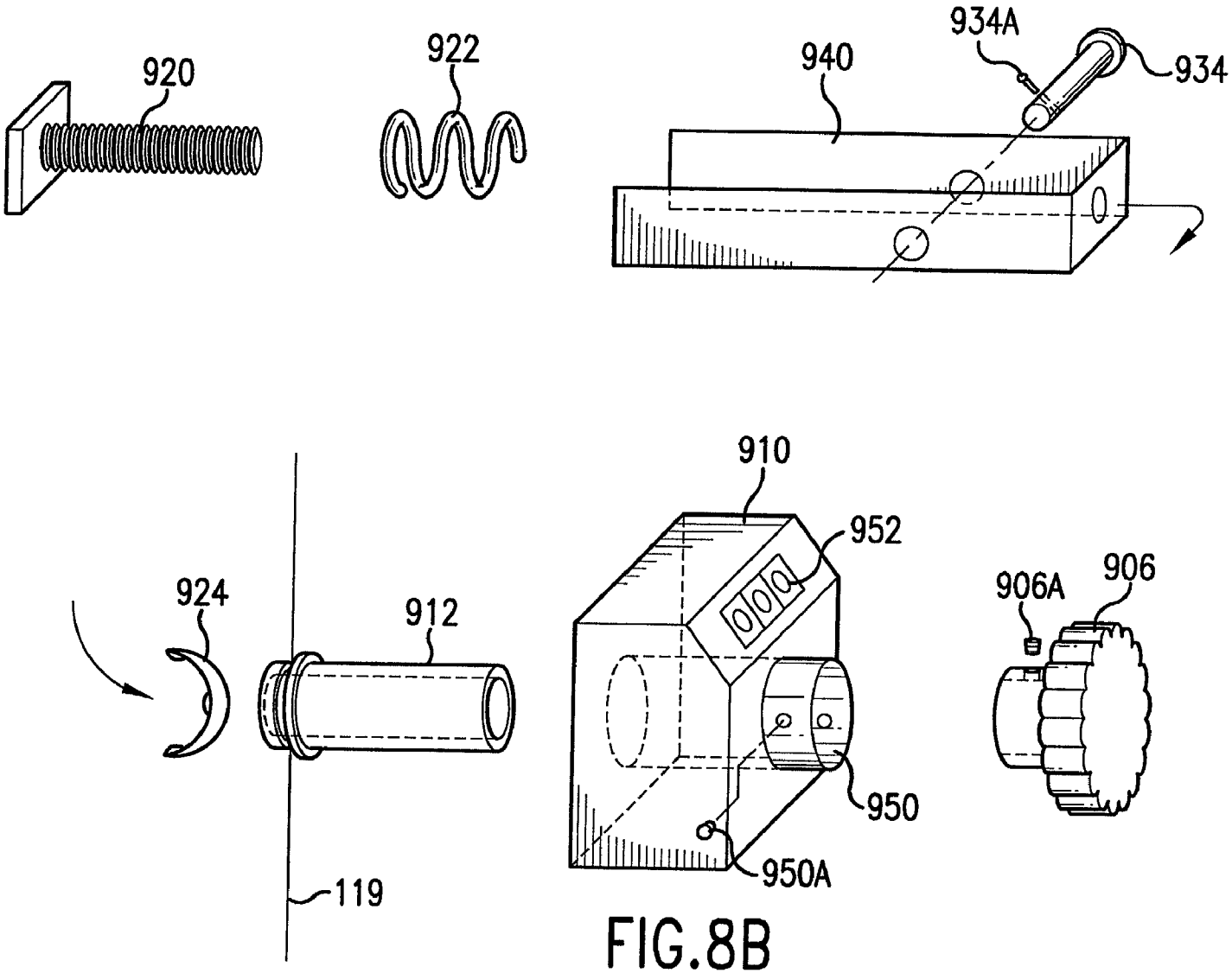
FIG. 8B is an exploded perspective view of an embodiment of a portion of the variable resistance mechanism in accordance with the principles of the present invention.
Figure 9:
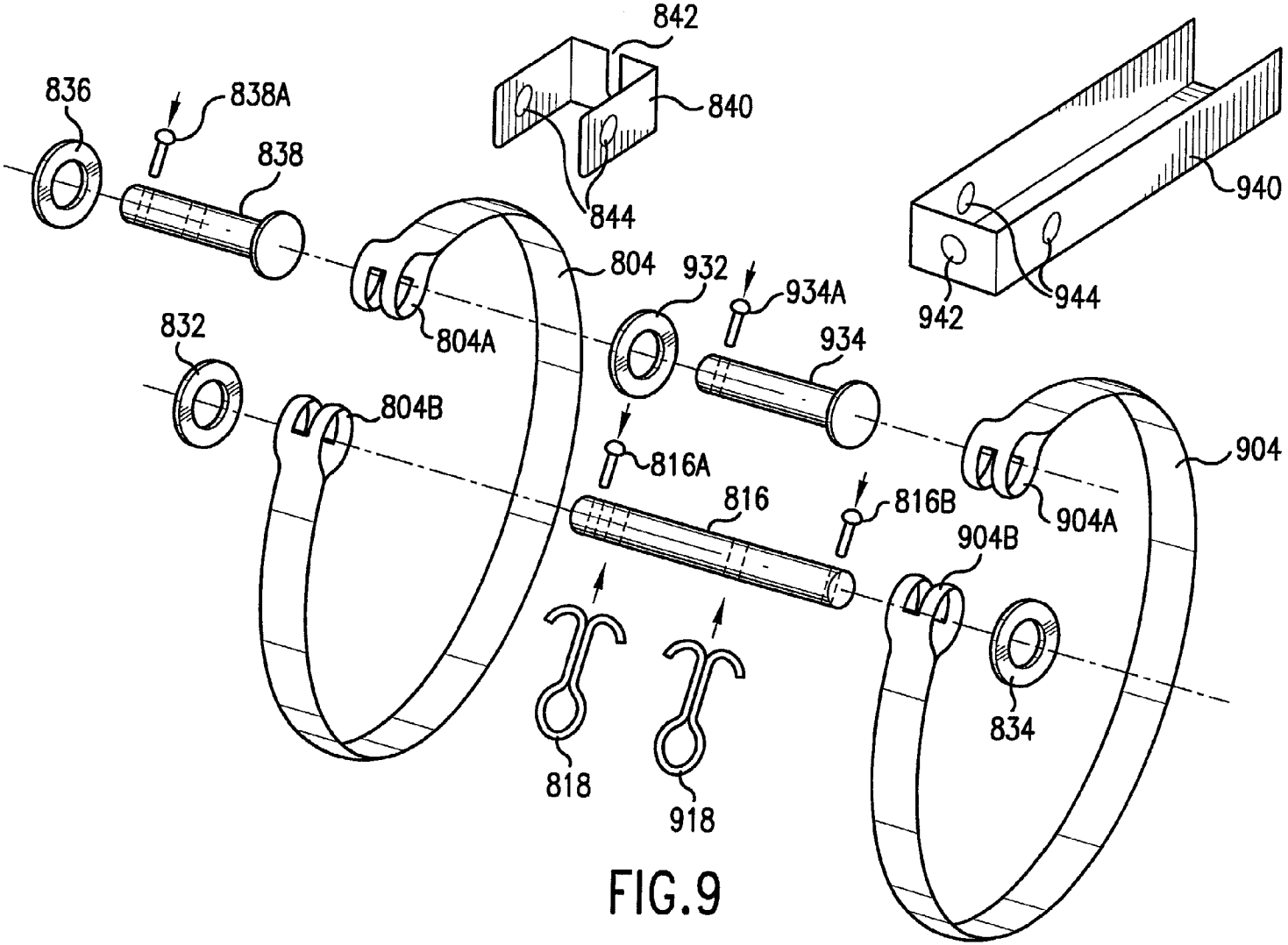
FIG. 9 is an exploded perspective view of an embodiment of another portion of the variable resistance mechanism and the safety brake mechanism in accordance with the principles of the present invention.
Figure 10:
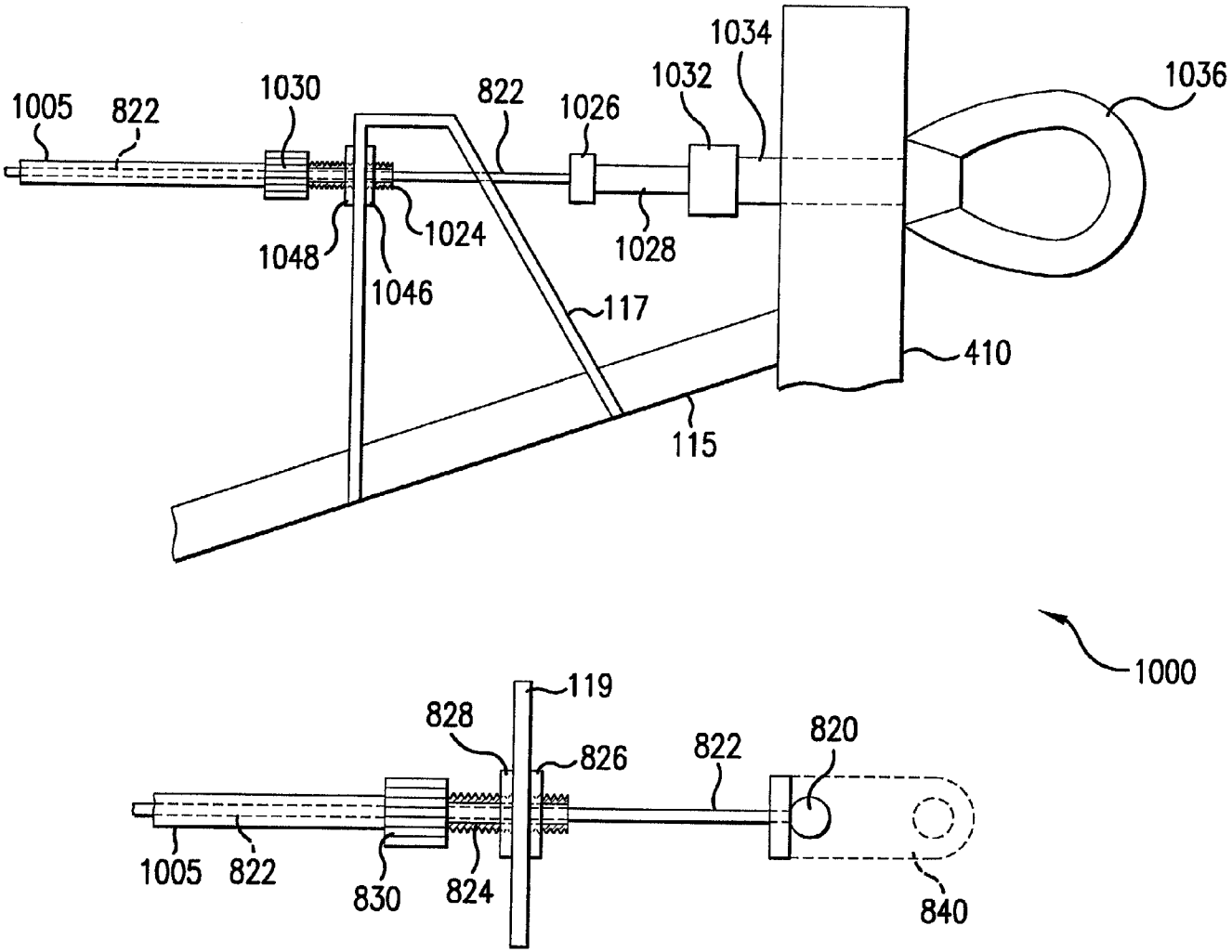
FIG. 10 is a side view of a cable assembly of the safety brake mechanism of the exercise machine.

Safety brake mechanism 800 and variable resistance mechanism 900 will now be further described with reference to FIGS. 5-10. FIGS. 5 illustrates a side view of safety brake mechanism 800. FIG. 6 illustrates a side view of variable resistance mechanism 900. FIG. 7 illustrates a top view of both mechanisms 800, 900. FIGS. 8A, 8B, and 9 show exploded views of portions of both mechanisms 800, 900. And FIG. 10 shows safety cable assembly 1000 of safety brake mechanism 800.

As can be seen in FIG. 5, safety brake hub 802 is slid onto grooved portion 214 and contacted with grooved portion 214 at hub groove 802A and axle groove 214A by key 213. Safety brake hub 802 is maintained in position by set screw 898. Safety brake hub 802 is surrounded by safety band brake 804 which provides the braking force to hub 802 in order to stop roller 200. One end of safety band brake 804 is connected to safety brake pin 838 and the other end is connected to band brake axle 816, where pin 838 and axle 816 are disposed perpendicular to the direction of rotation of roller 200. The connections will be further described later with reference to FIG. 9.

Safety brake pin 838 is disposed within a cable spring housing 840, where the ends of pin 838 are attached to the sides of cable spring housing 840. A brake spring 812 is attached at one end to a mid-portion of safety brake pin 838 through an opening in pin 838. The attachment helps secure one end of band brake 804 in place. Brake spring 812 is attached at the other end to a safety brake screw 806 through an aperture 810 in the head of screw 806. Brake spring 812 has hooks at both ends for attaching. Screw 806 fixes the spring assembly to a forward face of frame extension housing 119 via a safety brake nut 808.

Band brake axle 816 is attached to the exterior-most side of frame extension housing 119 at one end (below the safety brake screw 806 attachment) and to second axle support 116 at the other end. A first coupler 818 is positioned in a first opening through band brake axle 816 to secure the other end of band brake 804 in place.

A safety brake cable 822 connects to a cable pin 820 through a rear opening in cable spring housing 840. Safety brake cable 822 runs through a cable conduit 1005 which connects safety brake mechanism 800 to harness assembly 500. The connection will be described later with reference to FIG. 10. Cable spring housing 840 is movably positionable above safety brake hub 802. An exploded view of a portion of safety brake mechanism 800 is shown in FIG. 8A.

As can be understood, the amount of the braking force on exercise machine 10 may be changed by forwardly threading more of screw 806 through nut 808 such that cable spring 812 is positioned more forwardly and in-turn band brake 804 is tightened around brake hub 802.

A description will now be provided about the operation of safety brake mechanism 800. At rest, safety band brake 804 fits tightly around safety brake hub 802, applying a braking force to hub 802 and, hence, to roller 200. When the user pulls exercise machine 10, the user pulls harness 520 which in-turn pulls safety brake cable 822. As such, harness 520 transmits a pulling force through harness assembly 500 and safety brake cable assembly 1000 to safety brake mechanism 800. Cable 822 is pulled through cable conduit 1005 forward toward the user and rearward from safety brake hub 802. Cable 822 pulls cable spring housing 840 rearward as cable 822 moves, which in-turn causes brake spring 812 to expand and band brake 804 to move generally upward and rearward from hub 802, thereby loosening the fit of band brake 804 around and removing the braking force on safety brake hub 802. As a result, safety brake hub 802 rotates freely, which then allows roller 200 to rotate as well.

When the user stops pulling exercise machine 10, the process is reversed, such that cable spring 812 compresses and band brake 804 returns to its tight fit around hub 802. Safety brake hub 802 and, hence, roller 200 then stop.

As can be seen in FIG. 6, variable resistance hub 902 is slid onto grooved portion 214 and contacted with grooved portion 214 at hub groove 902A and axle groove 214A by key 213. Variable resistance hub 902 is maintained in position by set screw 998. Variable resistance hub 902 is surrounded by variable resistance band brake 904 which provides the resistance force to hub 902 in order to variably adjust resistance on roller 200. One end of variable resistance band brake 904 is connected to variable resistance pin 934 and the other end is connected to band brake axle 816, where pin 934 and axle 816 are disposed perpendicular to the direction of rotation of roller 200. The connections will be further described later with reference to FIG. 9.

As previously described, band brake axle 816 is attached to the exterior-most side of frame extension housing 119 at one end and to second axle support 116 at the other end. A second coupler 918 is positioned in a second opening through band brake axle 816 to secure one end of band brake 904 in place. This second opening is adjacent to the first opening through which first coupler 818 secures one end of band brake 804 in place.

Variable resistance pin 934 is disposed within a clevis 940, where the ends of pin 934 are attached to the sides of clevis 940. Clevis 940 extends rearwardly toward the rear face of frame extension housing 119 and is movably positionable above variable resistance hub 902. A square head adjustment bolt 920 passes through a front opening in clevis 940 and is screwed into an adjustment nut 912. Adjustment nut 912 is disposed through a front opening in frame extension housing 119, a small portion of nut 912 extending rearwardly through housing 119 and a larger portion extending forwardly through housing 119. A lock ring 924 is attached to the small portion of nut 912 that extends rearwardly through the front opening of housing 119. Lock ring 924 is disposed against the rear side of the front opening of housing 119 and keeps bolt 920 and nut 912 from coming unscrewed. Knob 906 is connected to the other end of nut 912. Adjustment bolt 920 is disposed above variable resistance hub 902 and is positioned parallel to hub 902 from its square head to its connection to nut 912. The square head of adjustment bolt 920 is forwardly adjacent to pin 934 and the attached end of band brake 904.

In order to provide an accurate dynamic resistance range of bolt 920 and, hence, band brake 904, a tension spring 922 is disposed inside clevis 940 and surrounds the portion of bolt 920 inside clevis 940. Tension spring 922 provides tension between the square head of bolt 920 and the forward face of clevis 940 in order to stabilize bolt 920 at the desired resistance position defined by the number of turns of knob 906. Additionally, the rear ends of clevis 940 are motion stops, which contact the rear face of frame extension housing 119 when resistance counter 910 reaches zero, thereby preventing further turns of bolt 920 which in-turn prevents counter 910 from counting backwards beyond zero.

The present invention is not limited to a particular force of tension spring 922; however, in a particular embodiment, an 80-pound spring is used to provide the accurate resistance range. A spring with either too little or too much force could cause band brake 904 to either tighten too much or too little for a given turn of knob 906.

Optionally, a spacer (not shown) may be attached to a mid-portion of pin 934 through an opening in pin 934 to help secure the other end of band brake 904 in place. An exploded view of a portion of variable resistance mechanism 900 is shown in FIG. 8B.

Resistance counter 910 is attached to the front face of frame extension housing 119. On the front of resistance counter 910 is display 952. Resistance counter 910 measures the number of turns of knob 906, i.e., the resistance applied by band brake 904 to variable resistance hub 902 and hence roller 200. Display 952 shows the resistance on exercise machine 10 in tenths of knob turns. As shown in FIG. 8B, the end of bolt 920 is threaded into adjustment nut 912 and secured with lock ring 924. This assembly is then slid into a barrel 950 of resistance counter 910. The end of nut 912 attached to lock ring 924 is secured in place against barrel 950 by miniature notches and the other end of nut 912 is secured by a set screw 950A threaded through barrel 950 to contact nut 912. Knob 906 is attached over the other end of barrel 950 and secured with a set screw 906A threaded through a opening in the yoke of knob 906.

As may be understood, resistance counter 910 may be any sensing and/or processing device, including a general purpose microprocessor, capable of measuring and/or performing calculations on a measurement. Display 952 may be any display device, analog or digital, capable of displaying information.

A description will now be provided about the operation of variable resistance mechanism 900. At rest, variable resistance band brake 904 fits loosely around variable resistance hub 902, applying minimum resistance to hub 902 and, hence, to roller 200. As the user turns knob 906 clockwise, the user increases the resistance on roller 200. As knob 906 turns clockwise, adjustment bolt 920 is forwardly threaded into adjustment nut 912 such that the square head of bolt 920 moves forward. This forward threading in-turn causes clevis 940 to move forward. Since band brake 904 is attached to clevis 940 through pin 934, the forward movement of clevis 940 causes band brake 904 to move forward thereby tightening the fit of band brake 904 around and increasing a resistance force on variable resistance hub 902. Tension spring 922 compresses and provides a counter-force on bolt 920 to stabilize bolt 920, thereby providing an accurate resistance setting. As knob 906 turns, barrel 950 turns, incrementing counter 910, and nut 912 turns, forwardly threading bolt 920 into nut 912. Resistance counter 910 counts the number of turns of knob 906 and display 952 shows the count. As resistance increases, variable resistance hub 902 does not rotate as freely, which causes roller 200 to rotate less freely as well.

When the user reduces resistance on exercise machine 10 by turning knob 906 counterclockwise, the process is reversed, such that band brake 904 returns to its loose fit around hub 902. Variable resistance hub 902 and, hence, roller 200 then move freely. When counter 910 reaches zero, clevis 940 contacts the rear face of frame extension member 119 to stop movement of variable resistance mechanism 900. Resistance counter 910 counts the number of turns of knob 906 and display 952 shows the count.

FIG. 9 illustrates the connections between band brakes 804, 904 and band brake axle 816 and pins 838, 934. As can be seen, safety band brake 804 and variable resistance band brake 904 are looped at both ends, to surround band brake axle 816 and pins 838, 934. Optionally, band brakes 804, 904 may have slits in portions of the looped ends which allow various devices to attach to underlying axle 816 and pins 838, 934 and/or to help hold band brakes 804, 904 in place. As shown in FIG. 7, brake spring 812 connects to pin 838 through the slit at end 804A of band brake 804. Similarly, couplers 818, 918 connect to axle 816 through the slit at end 804B of band brake 804 and the slit at end 904B of band brake 904, respectively.

Safety brake pin 838, surrounded by band brake end 804A, is positioned within and attached with a key 838A to cable spring housing 840 through apertures 844. A washer 836 may be placed between the side of housing 840 and key 838A. Similarly, variable resistance pin 934, surrounded by band brake end 904A, is positioned within and attached with a key 934A to clevis 940 through apertures 944. A washer 932 may be placed between the side of clevis 940 and key 934A. Band brake axle 816, surrounded by band brake ends 804B, 904B, is fixed to the exterior-most side of frame extension housing 119 by a key 816A at one end and to second axle support 116 by a key 816B at the other end. Washers 832, 834 may be placed between key 816A and housing 119 and key 816B and support 116. FIG. 7 shows a top view of these connections.

FIG. 10 shows a side view of portions of safety brake cable assembly 1000 of safety brake mechanism 800. As can be seen, one end of safety brake cable assembly 1000 is attached to harness assembly 500 through attachment member 410 and the other end is attached to frame extension housing 119. Safety brake cable assembly 1000 includes safety brake cable 822, cable conduit 1005, and various attachment devices.

Cable conduit 1005 is a hollow tube fixed at one end to a first cable conduit connector 830. First cable conduit connector 830 is also a hollow tube with a threaded interior for connecting cable conduit 1005 in one end and a first hollow cable screw 824 in the other. First hollow cable screw 824 is fixed into the rear face of frame extension housing 119 with cable nuts 826, 828.

Cable conduit 1005 is fixed at the other end to a second cable conduit connector 1030. Second cable conduit connector 1030 is also a hollow tube with a threaded interior for connecting cable conduit 1005 in one end and a second hollow cable screw 1024 in the other. Second hollow cable screw 1024 is fixed into the rear face of safety brake cable support 117 with cable nuts 1046, 1048.

Safety brake cable 822 runs through cable conduit 1005 and the various attachment devices. At one end, safety brake cable 822 exits cable conduit 1005 and hollow cable screw 1024, passes through the front opening in safety cable support 117, and connects to a first cable connector 1026. A series of cable connectors 1028, 1032, 1034 connect to first cable connector 1026. Connector 1034 passes through aperture 420 of attachment member 410 and attaches to a harness loop 1036. Harness loop 1036 is used to connect harness assembly 500. Connector 1034 slides freely through aperture 420 as the user applies a pulling force to harness 520. Connector 1032 and harness loop 1036 provide motion stops at the ends of connector 1034 to define the range of motion of cable 822.

At its other end, safety brake cable 822 exits cable conduit 1005 and hollow cable screw 824, passes through cable pin opening 842 of cable spring housing 840, and connects to cable pin 820.

As the user pulls exercise machine 10, the end of safety brake cable 822 attached to cable pin 820 moves rearward as safety brake cable 822 moves through cable conduit 1005, which in-turn expands brake spring 812, thereby releasing the braking force on exercise machine 10. The end of safety brake cable 822 attached to connector 1026 moves toward the user in the direction of motion.

When the user stops pulling exercise machine 10, tension on brake spring 812 is released causing spring 812 to compress and pull safety brake cable 822 back in the opposite direction through cable conduit 1005, thereby applying the braking force to exercise machine 10. The end of safety brake cable 822 attached to cable pin 820 moves forward and the other end moves rearward.

Figure 11:
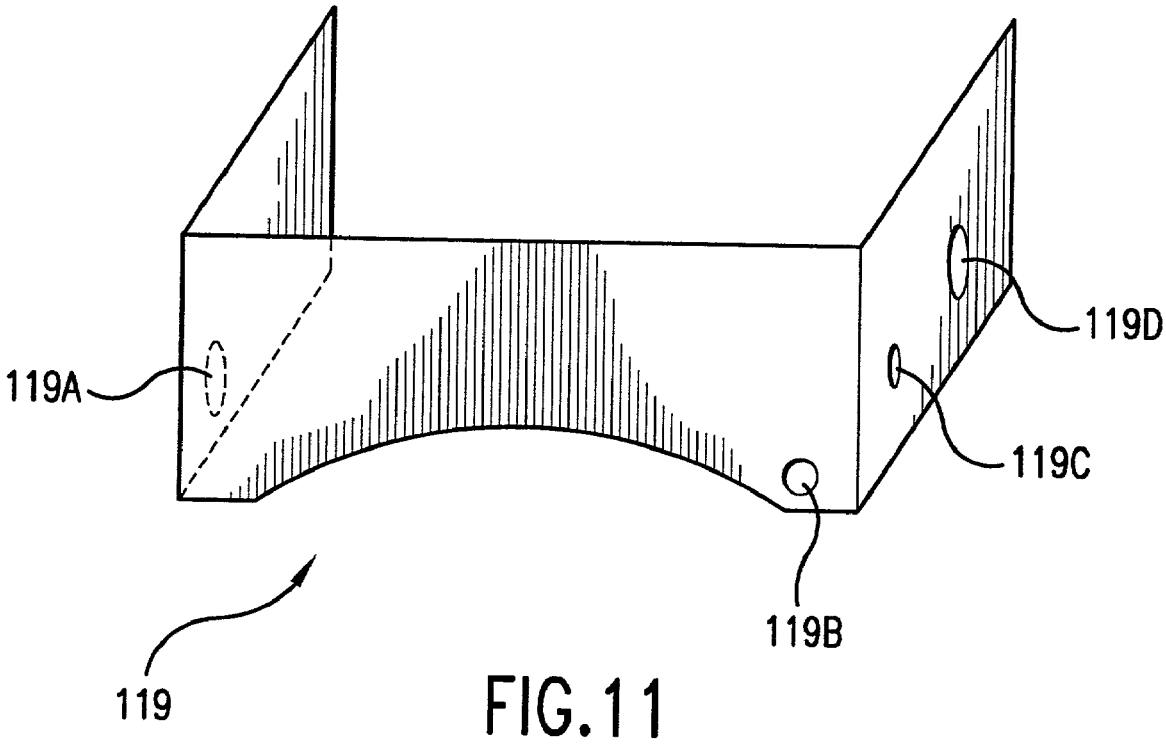
FIG. 11 is a perspective view of an embodiment of a frame extension housing which surrounds the safety brake mechanism and the variable resistance mechanism of the present invention.

FIG. 11 shows an embodiment of frame extension housing 119. As described previously, housing 119 has a three-sided structure that surrounds variable resistance mechanism 900 and safety brake mechanism 800. Ends of housing 119 attach to the exterior side of second axle support 116. Safety brake cable assembly 1000 attaches to cable spring housing 840 through opening 119A in the rear face of housing 119. One end of band brake axle 816 attaches to the exterior-most side of housing 119 through opening 119B. Screw 806 of safety brake mechanism 800 passes through opening 119C and knob 906 of variable resistance mechanism 900 passes through opening 119D. As can be understood, the present invention is not limited to the embodiment of housing 119 described herein. Any structure capable of covering and/or protecting the components of mechanism 800, 900 may be used.

Figure 12:
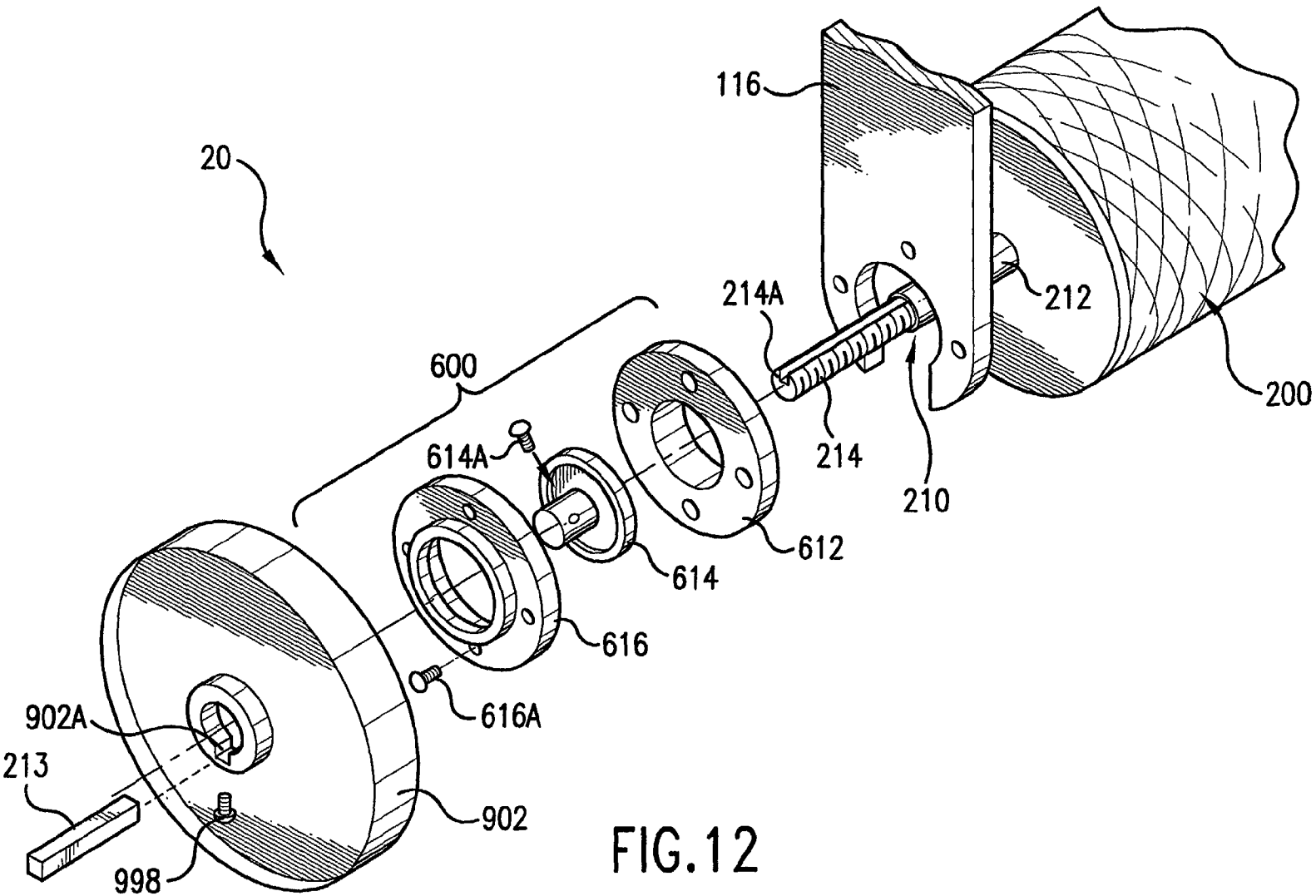
FIG. 12 is an exploded perspective view of a portion of the components included in the right side of the exercise machine.

FIG. 12 illustrates a portion of the right side 20 of exercise machine 10, including right roller retention bearing assembly 600. Right bearing assembly 600 includes a first bearing housing 612, a bearing 614, and a second bearing housing 616. In order to secure roller 200 to second axle support 116, the round cross-section portion 212 of axle 210 is positioned within a cut-out portion in the lower end of second axle support 116. First bearing housing 612 is aligned on second axle support 116 such that the apertures included in first bearing housing 612 are aligned with the apertures included in second axle support 116. Bearing 614, which has a hollow round shaft forwardly attached to it that is complementary in shape to axle portion 212 of axle 210, is then positioned on an opposing side of first bearing housing 612 from that which bears against second axle support 116. Bearing 614 is secured to axle portion 212 by a set screw 614A through an opening in the bearing's hollow shaft. Second bearing housing 616 is then positioned over bearing 614 and carriage bolts 616A are then positioned through the aligned apertures of second bearing housing 616, first bearing housing 612, and second axle support 116 and are utilized to secure right bearing assembly 600 to the lower end of second axle support 116. Thus, in this manner, axle 210 is rotatably secured to second axle support 116. The relative positioning of axle 210 and second axle support 116, and specifically, portion 212 of axle 210 with respect to second axle support 116, is locked in place by set screw 614A in bearing 614. After right roller retention bearing assembly 600, variable resistance hub 902 is mounted on grooved portion 214 of axle 210 as previously described.

Figure 13:
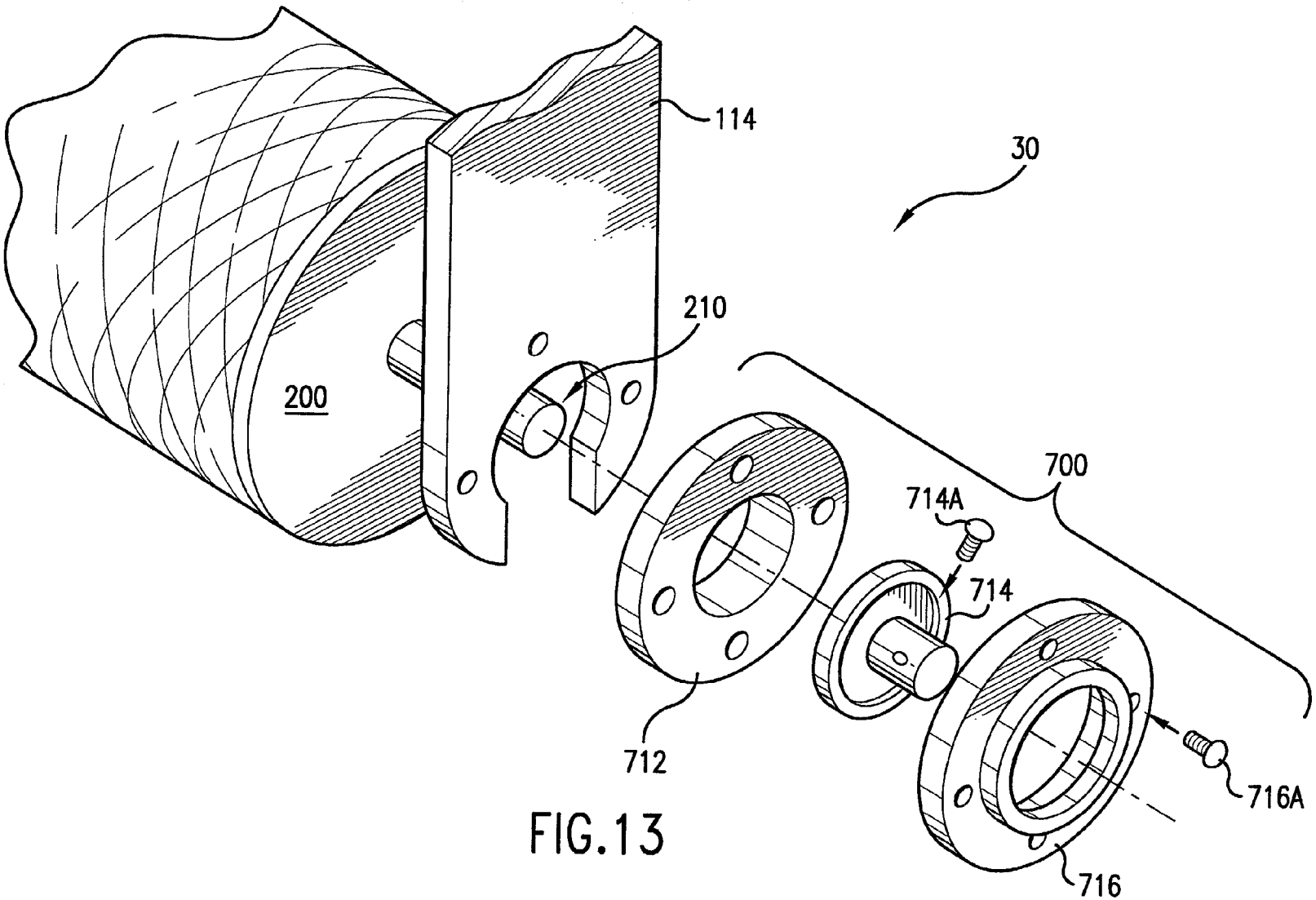
FIG. 13 is an exploded perspective view of a portion of the components included in the left side of the exercise machine.

FIG. 13 illustrates the left side 30 of exercise machine 10. As can be seen, because safety brake and variable resistance mechanisms 800, 900 are only associated with the right side 20 of exercise machine 10, axle 210 only includes a round portion in cross-section on the left side 30 of the exercise machine. First axle support 114 of left side 30 is associated with roller 200 similar to the manner in which second axle support 116 is associated with roller 200. As such, axle 210 is positioned within the cut-out portion that is included at the lower end of first axle support 114. A left roller retention bearing assembly 700 includes a first bearing housing 712, a bearing 714, and a second bearing housing 716. Left bearing assembly 700 is assembled and positioned onto both axle 210 and first axle support 114 similar to the manner in which right bearing assembly 600 is positioned on second axle support 116 and axle 210. Because left roller retention assembly 700 is similar to right roller retention bearing assembly 600, no further description will be provided herein for left roller retention bearing assembly 700.

Figure 14:
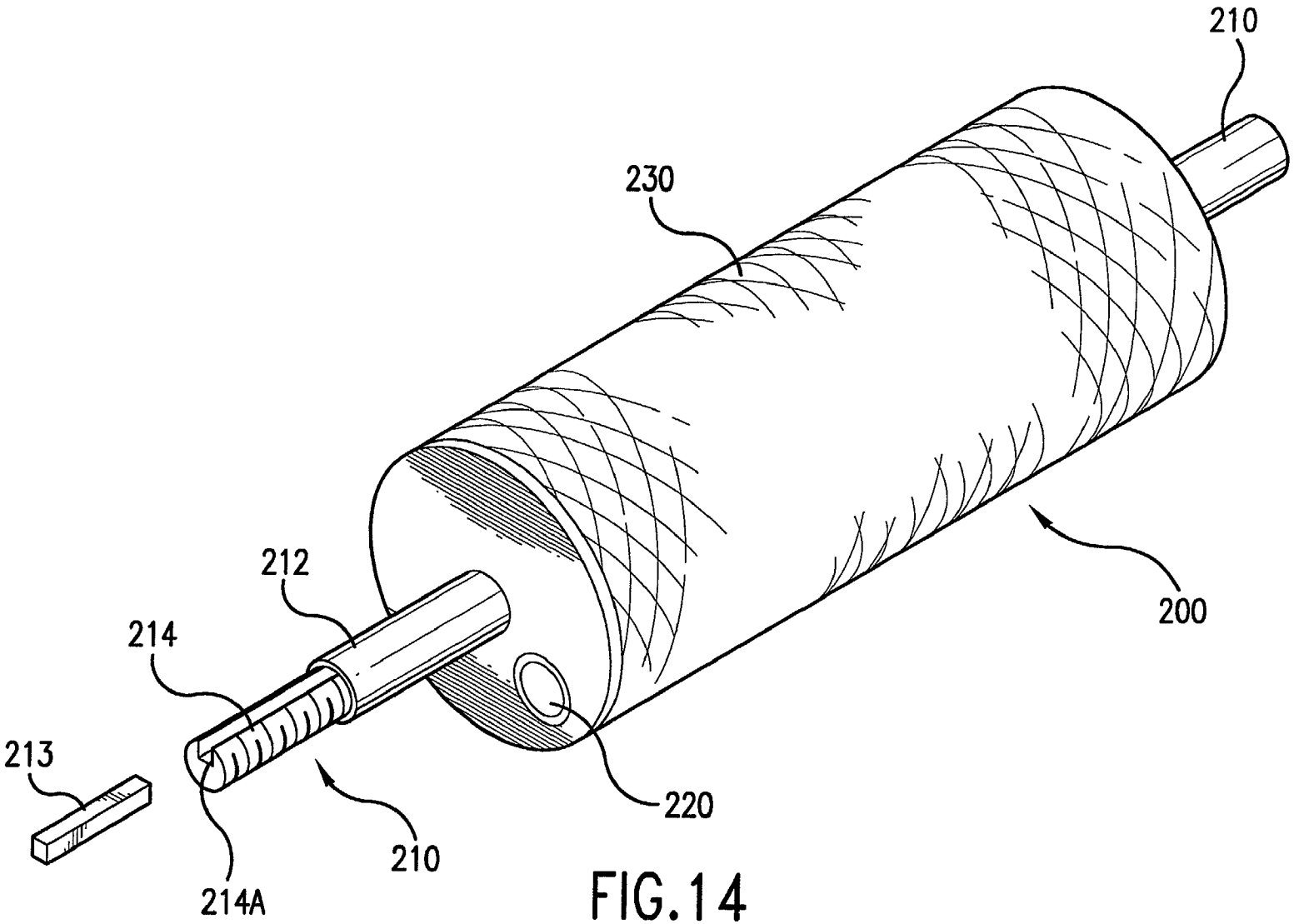
FIG. 14 is a perspective view of an embodiment of a roller in accordance with the principles of the present invention.

FIG. 14 further illustrates roller 200. As can be seen, and as described previously, axle 210 includes round portion 212 which extends through roller 200 and grooved portion 214 with groove 214A that is associated with safety brake mechanism 800 and variable resistance mechanism 900. Because of the complementary structures of axle portion 212 and the bore through roller 200, in which axle portion 212 is received, axle 210 rotates along with roller 200. As was previously described, roller 200 may include aperture 220 through which additional weight may be added to the interior of roller 200. Additionally, as discussed previously, any of a variety of materials 230 may be applied to the outer surface of roller 200. Materials that could be applied to the outer surface of roller 200 to provide for additional resistance could include expanded metals and other materials that have discontinuities in their surfaces, e.g., raised portions from the surface of the material.

As discussed previously, the present invention is not limited to any particular dimensions for roller 200, however, in a particular embodiment, the roller has a length of 24 inches and a diameter of 12 inches.

As described above, an exercise machine is provided that includes a mechanism for variably adjusting the resistance provided by the exercise machine against a pulling force applied by the user of the exercise machine and a mechanism for safely stopping the exercise machine when the user stops, thereby preventing the exercise machine from rolling into the user, possibly causing injury. The exercise machine provides the advantages of including a roller that is comprised of a single structural member. The roller may be elongated in length to provide a greater surface area for contact with the ground surface for enhancing the resistance provided by the exercise machine, when compared against exercise machines that are supported on wheels. The present invention includes an elongated roller but does not require an excessive width for the exercise machine as a whole due to the present invention's positioning of the roller within the frame structure of the exercise machine and the safety brake and variable resistance mechanisms' positioning external to the roller and frame. Thus, the variable resistance mechanism and safety brake mechanism are able to be comprised of relatively simple structures since they does not have to associate with, and thus be positioned between, two wheels which support an exercise machine.

Representative resistance forces that may be provided by the exercise machine are provided below. An embodiment of the exercise machine weighs approximately 125 pounds, without any additional weight being added to the roller. Without applying a resistance force to the roller by the variable resistance mechanism, a force of approximately 20 pounds is required to pull the exercise machine along the ground surface. When the variable resistance mechanism applies a maximum resistance force to the roller, a force of approximately 90 pounds is required to pull the exercise machine.

If an additional weight of 150 pounds is added to the roller of the exercise machine, a force of approximately 35 pounds is required to pull the exercise machine when no resistance force is applied by the variable resistance mechanism. With the same weight of 150 pounds added to the roller and a maximum resistance force applied by the variable resistance mechanism, a force of 160 pounds is required to pull the exercise machine against the resistance provided by the exercise machine. Thus, as can be understood, when a weight of 150 pounds is added to the roller, the force required to pull the exercise machine increases by 15 pounds when no resistance is provided by the variable resistance mechanism. When maximum resistance is applied, 125 pounds of force is required to overcome the resistance provided by the exercise machine.

The braking forces that may be applied by the exercise machine are set based on the weight added to the roller. The maximum braking force for a weighted roller is somewhat higher than that of an empty roller. These forces may be adjusted, as described previously, for a specific roller weight configuration.

The above is a detailed discussion of the preferred embodiments of the invention. The full scope of the invention to which applicants are entitled is defined by the claims hereinafter. It is intended that the scope of the claims may cover other embodiments than those described above and their equivalents.

What is claimed is:

1. An exercise machine, comprising:

a movable portion engageable by a user, said movable portion having a rigid member;

a braking member biased toward said rigid member, said braking member configured to apply a braking force to said rigid member; and a pulling member configured to be connected to said movable portion to disengage said braking member from said rigid member when said user moves said movable portion, wherein said movable portion includes:

a frame having a first axle support and a second axle support;

a roller disposed between said first axle support and said second axle support; and an axle extending through said roller and having a portion extending external to said second axle support;

wherein said rigid member is connected to said external portion of said axle.

2. The exercise machine of claim 1, wherein said frame includes:

an overhead frame including:

a first arm;

a second arm;

a third arm; and a fourth arm;

wherein said first axle support is attached to said first arm and extends downwardly perpendicular to said first arm;

wherein said second axle support is attached to said second arm and extends downwardly perpendicular to said second arm;

wherein a first end of said third arm is attached to said first axle support and a second end of said third arm is attached to said second axle support, said third arm extending horizontally perpendicular to said first and second arms;

wherein a first end of said fourth arm is attached to a mid-portion of said third arm and extends upwardly and forwardly from said third arm.

3. The exercise machine of claim 2, wherein said frame further includes:

a front frame including:

a first arm;

a second arm;

a first arm extension;

a second arm extension; and a cross member;

wherein a first end of said first arm of said front frame is attached to a first end of said first arm of said overhead frame, said first arm of said front frame extending forwardly and downwardly from said first arm of said overhead frame, and wherein a first end of said second arm of said front frame is attached to a first end of said second arm of said overhead frame, said second arm of said front frame extending forwardly and downwardly from said second arm of said overhead frame;

wherein a first end of said first arm extension is attached to a second end of said first arm of said front frame and wherein a first end of said second arm extension is attached to a second end of said second arm of said front frame;

wherein said cross member is attached at a first distal end to a second end of said first arm extension and at a second distal end to a second end of said second arm extension and wherein said cross member extends perpendicularly to said first and second arm extensions.

4. The exercise machine of claim 3, wherein said frame further includes:

a rear frame having a first arm and a second arm;

wherein a first end of said first arm of said rear frame is attached to a second end of said first arm of said overhead frame, said first arm of said rear frame extending rearwardly and downwardly from said first arm of said overhead frame, and wherein a first end of said second arm of said rear frame is attached to a second end of said second arm of said overhead frame, said second arm of said rear frame extending rearwardly and downwardly from said second arm of said overhead frame;

wherein a second end of said first arm of said rear frame is connected to a second end of said second arm of said rear frame.

5. The exercise machine of claim 4, wherein said movable portion further includes:

a support member;

wherein said support member is attached to a second end of said fourth arm of said overhead frame;

wherein said support member is attached to a mid-portion of said cross member below said attachment of said second end of said fourth arm of said overhead frame and extends perpendicular to said cross member.

6. The exercise machine of claim 5, wherein said support member includes one of a wheel and a skid at a first end thereof.

7. The exercise machine of claim 1, wherein said movable portion further includes an extension member attached to said frame, said extension member disposed on an external side of said second axle support and wherein said braking member is connected to said extension member.

8. The exercise machine of claim 1, further comprising:

an attachment member connected at one end to said braking member and connected at the other end to said pulling member, said attachment member configured to transmit said braking force to said braking member from said pulling member; and a compression member connected to and engageable with said braking member, said compression member configured to compress as said braking member applies said braking force.

9. The exercise machine of claim 1, wherein said braking member includes a band brake and said rigid member includes a hub, said band brake positioned to surround said hub.

10. An exercise machine, comprising:

a movable portion engageable by a user, said movable portion having a rigid member;

a braking member biased toward said rigid member, said braking member configured to apply a braking force to said rigid member;

a pulling member configured to be connected to said movable portion to disengage said braking member from said rigid member when said user moves said movable portion;

a second rigid member adjacent to said rigid member;

a resisting member configured to be connected to said second rigid member, said resisting member configured to apply a resistance to said second rigid member; and a variably adjusting member configured to be connected to said resisting member to variably adjust said resistance of said resisting member.

11. The exercise machine of claim 10, further comprising:

a housing member configured to connect said resisting member and said variably adjusting member, said housing member being movably positionable above said second rigid member; and a tension member disposed within said housing member and engageable with said resisting member, said tension member configured to compress as said resisting member applies said resistance.

12. The exercise machine of claim 11, further comprising:

a counting member connected to said variably adjusting member and configured to measure said resistance on said second rigid member; and a displaying member connected to said counting member and configured to display a value of said resistance.

13. The exercise machine of claim 10, wherein said resisting member includes a band brake and said second rigid member includes a hub, said band brake positioned to surround said hub.

14. The exercise machine of claim 10, wherein said variably adjusting member includes a knob.

15. An exercise machine, comprising:

a movable portion engageable by a user, said movable portion having a rigid member;

a resisting member configured to be connected to said rigid member, said resisting member configured to apply a resistance to said rigid member as said user moves said movable portion;

a variably adjusting member configured to be connected to said resisting member to variably adjust said resistance of said resisting member; and a connecting member configured to connect said resisting member and said variably adjusting member, said connecting member being movably positionable above said rigid member, wherein said movable portion includes:

a frame having an overhead frame, a front frame attached to a first end of said overhead frame, a rear frame attached to a second end of said overhead frame, and a first axle support and a second axle support attached to first and second ends, respectively, of said rear frame;

a roller disposed between said first axle support and said second axle support; and an axle extending through said roller and having a portion extending external to said second axle support;

wherein said rigid member is connected to said external portion of said axle.

16. The exercise machine of claim 15, further comprising:

a tension member disposed within said connecting member and engageable with said resisting member, said tension member configured to compress as said resisting member applies said resistance;

a counting member connected to said variably adjusting member and configured to measure said resistance on said rigid member; and a displaying member connected to said counting member and configured to display a value of said resistance.

17. The exercise machine of claim 15, wherein said resisting member includes a band brake and said rigid member includes a hub, said band brake positioned to surround said hub.

18. The exercise machine of claim 15, wherein said variably adjusting member includes a knob.

19. An exercise machine, comprising:

a movable portion engageable by a user, said movable portion having a rigid member;

a resisting member configured to be connected to said rigid member, said resisting member configured to apply a resistance to said rigid member as said user moves said movable portion;

a variably adjusting member configured to be connected to said resisting member to variably adjust said resistance of said resisting member;

a second rigid member adjacent to said rigid member;

a braking member biased toward said second rigid member, said braking member configured to apply a braking force to said second rigid member; and a pulling member configured to be connected to said movable portion to disengage said braking member from said second rigid member when said user moves said movable portion.

20. The exercise machine of claim 19, further comprising:

an attachment member connected at one end to said braking member and connected at the other end to said pulling member, said attachment member configured to transmit said braking force to said braking member from said pulling member; and a compression member connected to and engageable with said braking member, said compression member configured to compress as said braking member applies said braking force.

21. The exercise machine of claim 19, wherein said braking member includes a band brake and said rigid member includes a hub, said band brake positioned to surround said hub.

22. The exercise machine of claim 19, wherein said pulling member includes a harness assembly.

23. An exercise machine, comprising:

a movable portion engageable by a user, said movable portion having a first rigid member and a second rigid member, said second rigid member adjacent to said first rigid member;

a braking member biased toward said first rigid member, said braking member configured to apply a braking force to said first rigid member;

a pulling member configured to be connected to said movable portion to disengage said braking member from said first rigid member when said user moves said movable portion;

a resisting member configured to be connected to said second rigid member, said resisting member configured to apply a resistance to said second rigid member as said user moves said movable portion; and a variably adjusting member configured to be connected to said resisting member to variably adjust said resistance of said resisting member;

wherein said movable portion includes:

a frame including:

an overhead frame, a front frame attached to a first end of said overhead frame, and a rear frame attached to a second end of said overhead frame, wherein said frame is formed in an inverted u-shape configuration and defines an internal area defined by said overhead frame, said front frame, and said rear frame;

a roller attached to a lower end of said overhead frame and disposed within said internal area;

an axle extending through said roller and having a portion extending external to said internal area; and a frame extension member attached to said overhead frame and disposed external to said internal area;

wherein said first and second rigid members are connected to said external portion of said axle.

24. The exercise machine of claim 23, wherein said braking member includes a first band brake and said first rigid member includes a first hub, said first band brake positioned to surround said first hub.

25. The exercise machine of claim 23, wherein said resisting member includes a second band brake and said second rigid member includes a second hub, said second band brake positioned to surround said second hub.

26. The exercise machine of claim 23, wherein said variably adjusting member includes a knob.

27. The exercise machine of claim 23, wherein said pulling member includes a harness assembly.

28. An exercise machine having an automatic safety mechanism comprising:

(a) an elongated roller cylindrical in configuration and rotatable about its longitudinal axis for rolling over ground;

(b) a frame, including at least one rigid frame member, with a proximate end rotatably attached to said roller to permit said roller to roll about its axis and a distal end;

(c) a brake mechanism including a brake member rigidly affixed to said roller for rotation therewith;

(d) a brake engaging member for engaging said brake member to brake rotation of said roller;

(e) said brake mechanism further including a bias mechanism for biasing said brake engaging member into engagement with said brake member to brake rotation of said roller;

(f) a harness connected to said frame member at said distal end for engagement by a user to pull the frame and roller over ground;

(g) said harness being connected to said bias mechanism of the brake mechanism to overcome said bias and release said brake engaging member from engaging said brake member when the exercise machine is being pulled by the user;

(h) a variable resistance mechanism connected to said roller independently of said brake mechanism for applying resistance to the rotational movement of said roller;

(i) said harness, frame, roller and brake mechanism cooperating to permit the roller to be rolled over a surface by the user for exercise while automatically braking the roller when the user ceases to pull the machine.

29. The exercise machine of claim 1, wherein said pulling member includes a cable that pulls both forward toward said user and rearward from said rigid member in order to disengage said braking member.

30. The exercise machine of claim 1, wherein said pulling member includes a harness assembly.

31. The exercise machine of claim 15, wherein said variably adjusting member is configured to variably adjust said resistance of said resisting member by horizontally moving said resisting member relative to said variably adjusting member.

* * * * *